US006767588B2

(12) United States Patent
Almog et al.

(10) Patent No.: US 6,767,588 B2
(45) **Date of Patent: *Jul. 27, 2004**

(54) METHOD FOR PREPARING A PLASTIC SURFACE FOR PRINTING WITH TONER

(75) Inventors: Yaacov Almog, Nes-Ziona (IL); Sergio Brandriss, Rehovot (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

This patent is subject to a terminal disclaimer.

(21) Appl. No.: 10/182,558

(22) PCT Filed: Jan. 17, 2001

(86) PCT No.: PCT/IL01/00044

§ 371 (c)(1),
(2), (4) Date: Jul. 29, 2002

(87) PCT Pub. No.: WO01/58696

PCT Pub. Date: Aug. 16, 2001

(65) Prior Publication Data

US 2003/0012879 A1 Jan. 16, 2003

(30) Foreign Application Priority Data

Feb. 10, 2000 (IL) ..... PCT/IL00/00084

(51) Int. Cl.[7] ..... B05D 3/02

(52) U.S. Cl. ..... 427/393.5

(58) Field of Search ..... 427/385.5, 393.5

(56) References Cited

U.S. PATENT DOCUMENTS

| | | | | |
|---|---|---|---|---|
| 3,655,705 A | | 4/1972 | Lengnick | |
| 4,764,399 A | * | 8/1988 | Harrison | 427/275 |
| 4,832,984 A | | 5/1989 | Hasegawa et al. | |
| 5,407,771 A | | 4/1995 | Landa et al. | |
| 5,631,119 A | | 5/1997 | Shinozaki | |

FOREIGN PATENT DOCUMENTS

| | | |
|---|---|---|
| BR | 8601993 | * 11/1987 |
| DE | 2940370 | * 4/1981 |
| EP | 0 474 278 | 3/1992 |
| WO | WO 99/54143 | 10/1999 |
| WO | WO 01/22172 | * 3/2001 |

* cited by examiner

*Primary Examiner*—Erma Cameron
(74) *Attorney, Agent, or Firm*—Fenster & Company

(57) ABSTRACT

A method for preparing a plastic surface for printing with a toner comprising: forming a layer of an aqueous mixture comprising a first material and a second material on the surface, wherein the first material has an affinity for the plastic and the second material has an affinity for the first material and the toner, and drying the layer.

32 Claims, 1 Drawing Sheet

METHOD FOR PREPARING A PLASTIC SURFACE FOR PRINTING WITH TONER

RELATED APPLICATIONS

The present application is a U.S. national application of PCT/IL01/00044, filed Jan. 17, 2001.

The invention relates to printing on plastic and in particular to promotion of adhesion of printing inks to a plastic surface.

BACKGROUND

Surfaces of plastic products of all types, such as for example plastic shopping bags, place mats, and decals are printed for purposes of advertisement and decoration. However, common printing inks do not readily adhere to many plastics. Often a plastic surface that is to be printed must be treated prior to printing so that inks that are used to print the surface adhere properly to the surface. The treatment generally comprises coating the surface with a primer material that has a high affinity for both the plastic surface and the inks used to print the surface. The affinities of the primer for both the plastic and the ink bonds ink applied to the primer coated surface to the surface. Typically; the primer comprises or is mixed with volatile organic compounds potentially dangerous to human health that are released into the atmosphere during application of the primer to the surface. In order to protect people present in work areas where the primer is being used from exposure to the compounds, substantial resources have to be invested to properly ventilate the work areas and to monitor concentrations of the compounds in the air in the work areas.

U.S. Pat. No. 4,832,984 describes a water based system for coating plastics to receive inks, in which two layers of coating material are applied.

WO 99/54143 describes a water based coating system in which a mixture of two materials is used for coating the substrate prior to printing with liquid ink. One of the materials is a polyacid and the other is a polybase. The coating is between 2 and 30 g/m$^2$ of substrate. A surfactant is indicated as being useful. However, no details of its use are given.

EP 0 474 278 describes water based coating of an imaging film for dry toner. The coating includes two component mixed together.

SUMMARY OF THE INVENTION

An aspect of some embodiments of the invention relates to a method of coating a surface utilizing a coating material comprising an aqueous mixture of a first component having an affinity for a plastic substrate (hereinafter a "plastic bonding-agent") and a second component having an affinity for toner (hereinafter a "toner bonding-agent").

In accordance with some embodiments of the invention the coating, has a weight per square meter, when dry, of less than 1.5 grams.

In accordance with some embodiments of the invention, the second material is a neutralized acidic polymer.

In accordance with some embodiments of the invention a surfactant is added to the mixture, the surfactant having a w/w percentage of 0.5–2.5 percent of the aqueous mixture.

An aspect of some embodiments of the present invention relates to providing a primer, hereinafter referred to as a "pollution free primer", for bonding a toner ink to a plastic surface that does not release organic compounds into the air.

An aspect of some embodiments of the present invention relates to providing a pollution free primer that adheres with sufficient forces to the plastic surface and the toner so that the toner can be applied to the surface using an offset process.

In exemplary embodiments of the invention the affinities of the first and second components for each other and for the plastic and the toner are such that the toner is efficiently transferred to the plastic from a blanket used in an offset printing process. Preferably the first and second materials form relatively strong bonds to each other at least when dried.

In some embodiments of the present invention, the plastic bonding-agent is polyethylenimine (PEI) and the toner bonding-agent is a dispersed phase of MP4990, which is an aqueous dispersion of copolymer of polyethylene and acrylic acid, manufactured by Michelman, or its salt. Optionally, the primer is mixed with a surfactant that enhances wetting of the plastic surface by the primer and promotes formation of a uniform coating of the primer on the plastic surface.

The inventors have found that a thin substantially uniform coating of the primer can be applied to a side of a sheet or web of plastic using a gravure printing process, although other coating processes, as known in the art may be used. The primer adheres well to the plastic and the primer coated surface can be printed with liquid toners, such as for example those described in U.S. Pat. No. 5,407,771 to Landa et al., the disclosure of which is incorporated herein by reference. Toners are ElectroInk® produced and sold by Indigo N. V. of the Netherlands such as ElectroInk® EI-Mark 3.0 and EI-Mark 3.1 are suitable. Other toners can be used.

There is thus provided, in accordance with an exemplary embodiment of the invention, a method for preparing a plastic surface for printing with a toner comprising:

forming a layer of an aqueous mixture comprising a first material and a second material on the surface, wherein the first material has an affinity for the plastic and the second material has an affinity for the first material and the toner; and drying the layer, wherein, when dry, the layer has a weight per square meter of less than 1.5 grams.

Optionally, the weight per square meter is greater than about 0.1 gram, less than about 1 gram, between 0.1 and 0.2 grams or about 0.15 grams.

Optionally, the first material is polyethylenimine.

Optionally the second material is a material chosen from the group of materials comprising: polyethylene acrylic acid copolymer, styrene acrylate copolymer, styrene-butadiene and a salt of an acidic polymer.

Optionally, the weight of the first material plus the weight of the second material is between about 2% and about 10% of the weight of the mixture.

Optionally, the ratio of the weight of the second material to the weight of first material in the mixture is between 1 and 5. Optionally it is between 1 and 2 or between 2 and 3.

Optionally, second material is a neutralized acid polymer material.

There is further provided, in accordance with a preferred embodiment of the invention, a method for preparing a plastic surface for printing with a toner comprising:

forming a layer of an aqueous mixture comprising a first material and a second material on the surface, wherein the first material has an affinity for the plastic and the second material has an affinity for the first material and the toner; and drying the layer, wherein the second material is a neutralized acid polymer material.

Optionally, the acid polymer material is polyethylene acrylic acid copolymer.

In some embodiments of the invention, the method includes adding a surfactant to the mixture.

There is further provided, in accordance with an embodiment of the invention, a method for preparing a plastic surface for printing with a toner comprising:

forming a layer of an aqueous mixture comprising a first material and a second material on the surface, wherein the first material has an affinity for the plastic and the second material has an affinity for the first material and the toner and a surfactant in an amount by weight of the mixture of between 0.5 and 2.5%; and drying the layer, Optionally, the surfactant is chosen from the group of materials comprising: 2,4,7,9-tetramethyl-5-decyn-4,7-diol; 2,4,7,9-tetramethyl-5-decyn-4,7-diol+3.5 moles ethylene oxide; and sodium dodecyl sulfate.

When the surfactant is 2,4,7,9-tetramethyl-5-decyn-4,7-diol or 2,4,7,9-tetramethyl-5-decyn-4,7-diol+3.5 moles ethylene oxide, optionally, after addition of the surfactant, the mixture comprises between 1% and 1.5% by weight surfactant.

When the surfactant is sodium dodecyl sulfate, optionally, after addition of the surfactant, the mixture comprises between 2% and 2.5% by weight surfactant.

In an exemplary embodiment of the invention, the first material is dissolved in water. Optionally, the aqueous solution of the first material comprises between 2% and 10% by weight of the first material.

In an exemplary embodiment of the invention, the second material is dispersed in water. Optionally, the aqueous dispersion of the second material comprises between 2% and 10% by weight of the second material.

In an embodiment of the invention, forming the layer comprises preparing the mixture in accordance with a procedure comprising:

preparing an aqueous solution of the first material;

preparing an aqueous dispersion of the second material; and mixing the aqueous solution and the aqueous dispersion.

Optionally, forming the layer comprises forming a layer of an aqueous mixture that does not release organic compounds into the air during drying thereof.

Optionally, forming the layer of the mixture on the surface comprises applying the mixture to the surface using a gravure roller.

BRIEF DESCRIPTION OF FIGURES

The following non-limiting description of some embodiments of the invention, should be read in conjunction with the accompanying figures. In the figures, identical structures, elements or parts that appear in more than one figure are generally labeled with the same numeral in all the figures in which they appear. Dimensions of components and features shown in the figures are chosen for convenience and clarity of presentation and are not necessarily shown to scale. The figures are.

DETAILED DESCRIPTION OF EXEMPLARY EMBODIMENTS

Figure 1:
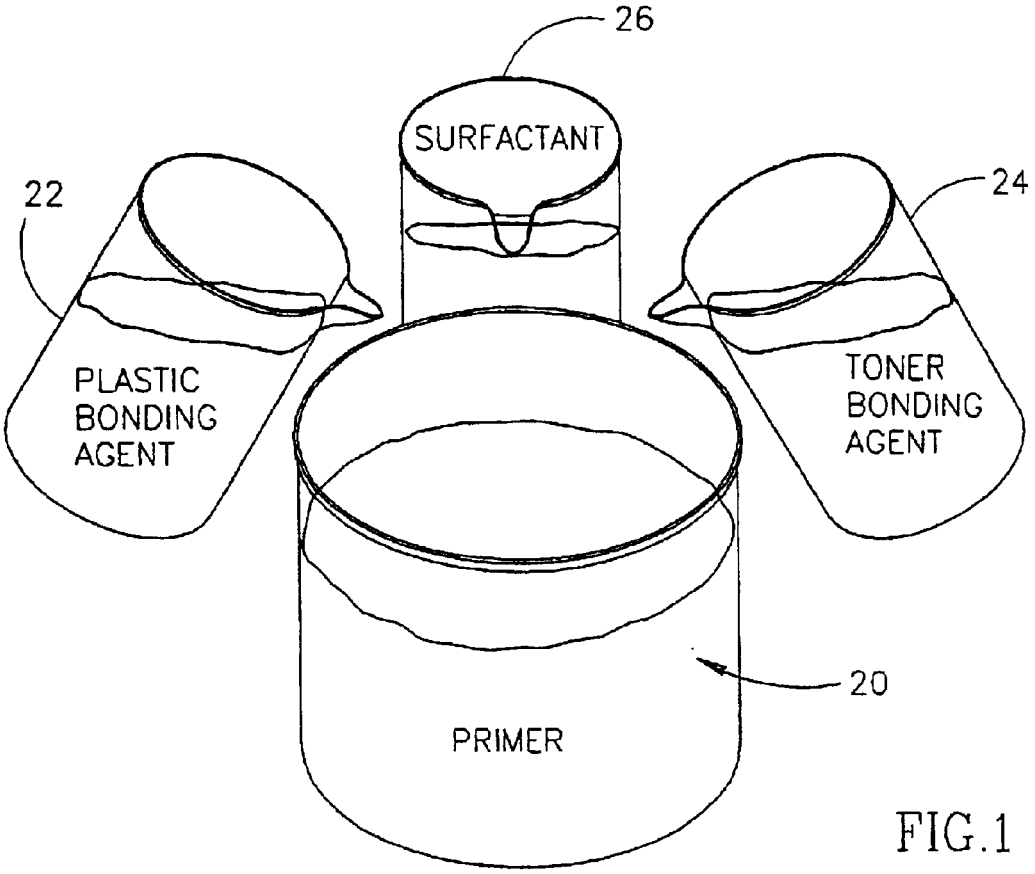
FIG. 1 schematically shows preparation of a primer, in accordance with an exemplary embodiment of the present invention.

FIG. 1 schematically illustrates preparation of a quantity of primer 20 by mixing an aqueous solution 22 of a water-soluble plastic bonding-agent with an aqueous dispersion 24 of an toner bonding-agent, in accordance with an exemplary embodiment of the present invention. Alternatively either component can be soluble or dispersible. Optionally, the plastic bonding-agent is polyethylenimine and solution 22 is 6%±4% (i.e. from 2% to 10%) by weight of polyethylenimine.

In some embodiments of the present invention, the toner bonding-agent is dispersed phase of MP4990 and the amount by weight of dispersed phase of MP4990 in aqueous dispersion 24 is about the same as the amount by weight of polyethylenimine in solution 22. Polyethylenimine solution 22 and "MP4990 dispersion 24" may be mixed together in equal quantities by weight. However, a quantity of MP4990 dispersion 24 may be mixed with a quantity of polyethylenimine solution 22 so that the ratio by weight of dispersed phase of MP4990 to polyethylenimine in primer 20, in accordance with another embodiment of the present invention, has any value in a range from 1 to 5. The large mixing range is possible because dispersed phase of MP4990 has an affinity of its own to plastic.

Other toner bonding-agents usable to prepare primer 20, in accordance with a other embodiment of the present invention, are a dispersed phase of Styrofan, Acronal 866 or Styronal D808. Styrofan and Styronal are trade names for aqueous polymer dispersions based on styrene-butadiene sold by BASF. Acronal is a trade name for acrylate homopolymers and copolymers in dispersed form sold by BASF. For these materials, aqueous dispersion 24 is by weight, for example, 8%±4% of a dispersed phase of Styrofan, Acronal 866 or Styronal D808. As in the case for dispersion 24 formed with MP4990, dispersion 24 formed with Styrofan, Acronal and Styronal or the neutralized acids described below, is optionally mixed with 6% polyethylenimine solution 22 in equal parts by weight of dispersion 24 to solution 22 to form primer 20. A quantity of dispersion 24 based on Styrofan, Acronal or Styronal may be mixed with a quantity of polyethylenimine solution 22 to provide a primer 20 in which the ratio of dispersed phase of Styrofan, Acronal or Styronal to polyethylenimine in the primer has a range between 1 and 5, in accordance with other embodiment of the present invention.

Other toner bonding agents are salts of at least some of the acids listed above. The inventor has discovered that while the above materials work well, their shelf life is sometimes limited, presumably due to an interaction between the base used as the plastic bonding agent and the acid used as the toner bonding agent. However, salts of the acids, when mixed with the plastic bonding agent have a long shelf life and have substantially the same effect as their acidic counterparts.

While this acid neutralization has not been tried with all acids, it is believed to generally applicable, such that when an acidic toner bonding agent is useful, its neutralized form is also useful.

In an embodiment of the invention, 334 g of Michem MP4990 diluted with 333 g or deionized water is mixed with 333 g of NaOH. Alternatively to sodium hydroxide, potassium hydroxide, ammonium hydroxide (NH4OH), and in general univalent metal hydroxides can be used to neutralize the acid polymer.

In some embodiments of the present invention, an optional surfactant 26 is added to primer 20. In some embodiments of the present invention, the surfactant is a solute in Surfynol 104E, which is an aqueous solution of 2,4,7,9-tetramethyl-5-decyn-4,7-diol, mfg. by Air Products Inc. Surfynol 104E is added to primer 20 so that optionally, after addition, the primer comprises between 0.5%–2.5% (optionally, between 0.5% and 1.5%) by weight of the solute in Surfynol 104E" (i.e. 2,4,7,9-tetramethyl-5-decyn-4,7-diol). In some embodiments of the present invention the surfactant is a solute in Surfynol 440, which is the solute in Surfynol 104±3.5 moles Ethylene oxide, mfg. By Air Products Inc. Surfynol 440 is added to primer 20 so that optionally, after addition, the primer comprises by weight about 0.5% to 2.5% (optionally between 0.5% and 1.5%) of the solute in Surfynol 440. In some embodiments of the present invention the surfactant is sodium dodecyl sulfate which is added to primer 20 so that after addition the primer comprises by weight about 0.5% to 2.5% surfactant (optionally between 1% or 2% and 2.5%). In the case of addition of a surfactant, optionally the amount by weight of polyethylenimine plus dispersed phase of MP4990, Styrofan, Acronal, Styronal or the neutralized form of MP4990 described below, in primer 20 is between 2% and 10%.

It should be noted that the above method for preparing a primer is given by way of example. Other methods known in the art for combining materials to prepare the primer may be used. For example, the primer can be formed by preparing an aqueous solution of a suitable plastic bonding-agent and dispersing a suitable toner bonding-agent in the solution or preparing an aqueous dispersion of the toner bonding-agent and dissolving the plastic bonding-agent in the dispersion.

Figure 2:
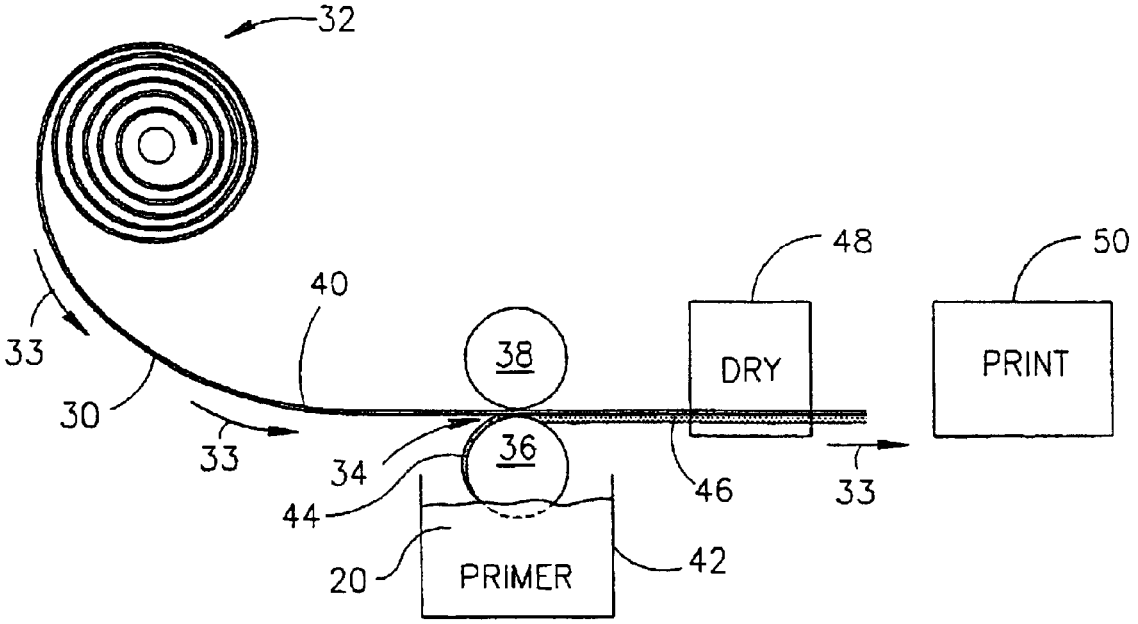
FIG. 2 schematically shows a method of printing on plastic using a primer in accordance with an embodiment of the present invention.

FIG. 2 schematically illustrates printing a plastic web 30 using primer 20, in accordance with an exemplary embodiment of the present invention. Web 30 is fed, for example, from a roll 32 in a direction indicated by arrows 33 so that it passes between a nip 34 of a rotating gravure cylinder 36 and a backing cylinder 38. Web 30 may be formed for example from bi-axial oriented polypropylene. Optionally, a corona treated side 40 of web 30 contacts gravure cylinder 36.

Primer 20 is applied to gravure cylinder 36 from an appropriate dispenser 42 using methods known in the art. Primer 20 that is applied to gravure cylinder 36 is schematically shown as a layer 44 of primer 20 on a region of the surface of gravure cylinder 36. As web 30 passes through nip 34, gravure cylinder 36 rotates and transfers primer 20 from layer 44 on its surface to web 30 to coat the web with a layer 46 of primer 20. Optionally, after drying the weight of layer 46 is about 0.1 to 1.5 grams for each square meter of the surface of web 30. In some embodiments of the invention, thicker layers can be used. Thinner layers can be used possibly resulting in less continuous coating. After passing through nip 34 and being coated with primer 20, web 30 passes through a drying station, represented by a rectangle 48, at which layer 46 of primer 20 is dried. By the time that layer 46 is dry, the plastic bonding-agent, (e.g. polyethylenimine), and the toner bonding-agent in the primer are bonded together. Web 30 then proceeds to a printer, represented by a rectangle 50, such as an Omnius printer, (mfg. By Indigo) where the primer coated surface 40 of web 30 is printed with a desired image. Optionally, web 30 is printed with liquid toner, such as for example, toners produced and sold by Indigo N. V. of the Netherlands under the trade names EI-Mark 3.0 and EI-Mark 3.1.

A liquid toner useful for practicing the present invention can be produced according to the process described below.

Ten parts, by weight, of Elvax II 5950 (Mfg. By Du Pont) and five parts by weight of Isopar L (mfg. By Exxon) are mixed for one hour at low speed in a jacketed double planetary mixer connected to an oil heating unit set at 130° C. An additional five part by weight of Isopar L are added to the mixture in the planetary mixer and after adding the additional Isopar L, the mixture is mixed at high speed for an additional hour. Ten parts by weight of Isopar L, preheated to 110° C. are then added and mixing is continued for an hour. The heating unit is then turned off and mixing is continued until the temperature of the mixture in the planetary mixer drops to about 40° C.

Ninety grams of the cooled mixture is transferred to a Union Process 01 attritor together with 7.5 g of Mogul L carbon black (sold by Cabot) and 120 g of Isopar L. The mixture thus formed is ground using 3/16" stainless steel media for 24 hours with water cooling, at about 20° C. to form a toner concentrate.

The toner concentrate is diluted in Isopar L to a non-volatile solids content 1.5%. For each gram of toner solids, 5–100 mg of charge director solution is added to form the liquid toner.

Whereas in FIG. 2 a plastic web is shown being coated with a primer and printed, plastic sheets and surfaces of plastic products can also be coated with primer and printed with toner inks in accordance with various embodiments of the present invention. Also, whereas in FIG. 2 the primer is shown being applied to the web using a gravure cylinder, primer may be applied to a suitable plastic surface using other methods known in the art, such as for example by spraying or wire coating. Furthermore, application and drying of primer, in accordance with some embodiment of the present invention, does not have to be done "in line" during a printing process as shown in FIG. 2. Primer can be applied to a surface of a plastic web, sheet or other suitable plastic product at a first site and at a first time and the surface can be printed at a second site at a second time. For example, after being coated with primer, the plastic web, sheet or product can be stored and printed later. In addition, in accordance with other embodiments of the present invention, the primer is useable with plastics other than bi-axial oriented polypropylene.

In developing pollution free primers suitable for bonding toner inks to plastic, in accordance with various embodiments of the present invention, the inventors developed water-based primers comprising different materials and combinations of materials. Each of the primers was tested to determine its suitability for use in printing on plastic by applying the primer to the corona treated side of a web of bi-axial oriented polypropylene. The primer was applied to the web to a coat weight of 0.15 g/m$^2$ using a gravure roller. The web was then printed with liquid toner ink EI-3.1 using an Omnius™ printer. The primer was tested for adherence to the surface of the web, uniformity of the primer coating formed on the web and how well toner transferred from a blanket in the printer to the primer and fixed on the web. The primers developed and tested do not release volatile organic materials. Examples of the primers and results of testing the primers, including those primers described in the discussion of FIG. 1, are presented and discussed in the following paragraphs.

In various embodiments of the present invention, the layer has a weight per square meter of plastic between 0.10 and 1.5 grams after the layer is dry. Specifically, thicknesses having any value between 0.1 and 1.5 grams can be chosen, with the thicker layers being more robust and the thinner ones being less expensive. Layers thinner than 0.1 grams/$m^2$ are generally are difficult to form as continuous layers. Thus, layers of 1.4, 1.3. 1.2, 1.1, 1, 0.9, 0.8 0.5 or less or any intermediate values can be used as desired.

EXAMPLE 1

A primer was prepared that comprised a 20% by weight aqueous solution of n-propanol in which dispersed phase of MP4990 was dispersed to a concentration of 12% by weight. The primer coating formed on the web was uniform and did not evidence patterning. However, adhesion of the primer to the web was poor as determined by a peel test. Transfer of ink from the blanket to the primer was unsuccessful and the primer detached from the web and adhered to the blanket.

EXAMPLE 2

Another primer comprised a 6% aqueous solution by weight of polyethylenimine mixed with an equal amount by weight, of a 6% aqueous dispersion of dispersed phase of MP4990. The mixture was stable and didn't exhibit phase separation. The primer adhered well to the web; however, it evidenced patterning due to relatively poor wetting of the web by the primer. Ink transfer and fixing were satisfactory.

EXAMPLE 3

A primer was prepared by forming a mixture comprising a 6% aqueous solution by weight of polyethylenimine mixed with an equal amount by weight of a 6% aqueous dispersion of dispersed phase of MP4990 (i.e. the primer of Example 2) or of its neutralized form, and adding to the mixture Surfynol 104E as a surfactant. The Surfynol was added to the mixture so that after addition the mixture was about 1% by weight solute from Surfynol 104E. Adhesion of the primer to the web was excellent and the primer formed a substantially uniform "un-patterned" coating on the web. Toner transferred to the primer successfully and fixing was satisfactory.

EXAMPLE 4

A primer similar to the primer of Example 3 was prepared in which Surfynol 440 was used as a surfactant added to a mixture comprising equal amounts by weight of a 6% aqueous solution of polyethylenimine and a 6% aqueous dispersion of dispersed phase of MP4990 or its neutralized form. Surfynol 440 was added to the mixture so that after addition the mixture was between 1% to 1.5% by weight solute from Surfynol 440. Adhesion of the primer to the web was excellent and the primer formed a substantially uniform coating on the web. Toner transferred successfully to the primer and fixing was satisfactory.

EXAMPLE 5

Another primer similar to the primer of Example 3 was prepared in which sodium dodecyl sulfate was used as a surfactant added to a mixture comprising equal amounts by weight of a 6% aqueous solution of polyethylenimine and a 6% aqueous dispersion of dispersed phase of MP4990 or its neutralized form. The sodium dodecyl sulfate was added to the mixture so that after addition, the mixture was between 2%–2.5% by weight sodium dodecyl sulfate. Adhesion of the primer to the web was excellent and the primer formed a substantially uniform coating on the web. Toner transferred successfully to the primer and fixing was satisfactory.

EXAMPLE 6

A primer was prepared by mixing one part by weight of a 6% aqueous solution of polyethylenimine and three parts by weight of a 6%, by weight of the aqueous dispersion of dispersed phase of Styrofan. Adhesion of the primer to the web was excellent, however, the primer coating evidenced patterning due to poor wetting of the web by the primer. Toner transfer was good and fixing was satisfactory.

EXAMPLE 7

A primer was prepared by mixing equal amounts by weight of a 6% aqueous solution of polyethylenimine and an aqueous dispersion of 12%, by weight of the dispersed phase of Acronal 866. Adhesion of the primer to the web was excellent however, the primer coating evidenced patterning due to poor wetting of the web by the primer. Toner transfer was good and fixing was satisfactory.

EXAMPLE 8

Another primer was prepared by mixing equal amounts by weight of a 6% aqueous solution of polyethylenimine and an aqueous dispersion that is 12%, by weight, dispersed phase of Stronal D808. Adhesion of the primer to the web was good however, the primer coating evidenced patterning due to poor wetting of the web by the primer. Toner transfer was good and fixing was satisfactory.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. Furthermore, the terms "comprise," "include," "have" and their conjugates, shall mean, when used in the claims, "including but not necessarily limited to". The scope of the invention is limited only by the following claims.

What is claimed is:

1. A method for preparing a plastic surface for printing with a toner comprising:

forming a layer of an aqueous mixture comprising a first material and a second material on the surface, wherein the first material has an affinity for the plastic and the second material has an affinity for the first material and the toner; and drying the layer, wherein, when dry, the layer has a weight per square meter of less than 1.5 grams.

2. A method according to claim 1 wherein the weight per square meter is greater than about 0.1 gram.

3. A method according to claim 2, wherein the weight per square meter is less than about 1 gram.

4. A method according to claim 1 wherein the weight per square meter is between about 0.10 and 0.20 grams.

5. A method according to claim 4, wherein the weight per square meter is about 0.15 grams.

6. A method according to claim 1, wherein the first material is polyethylenimine.

7. A method according to claim 1 wherein the second material is a material selected from the group consisting of: polyethylene acrylic acid copolymer, styrene acrylate copolymer, styrene-butadiene and a salt of an acidic polymer.

8. A method according to claim 7 wherein the weight of the first material plus the weight of the second material is between about 2% and about 10% of the weight of the mixture.

9. A method according to claim 7 wherein the ratio of the weight of the second material to the weight of first material in the mixture is between 1 and 5.

10. A method according to claim 7 wherein the ratio of the weight of the second material to the weight of the first material in the mixture is between 1 and 2.

11. A method according to claim 7 wherein the ratio of the weight of the second material to the weight of the first material in the mixture is between 2 and 3.

12. A method according to claim 7 wherein the ratio of the weight of the second material to the weight of the first material in the mixture is between 3 and 4.

13. A method according to claim 7 wherein the second material is polyethylene acrylic acid copolymer.

14. A method according to claim 7 wherein the second material is styrene acrylate copolymer.

15. A method according to claim 7 wherein the second material is styrene-butadiene.

16. A method according to claim 7 where the second material is a neutralized acid polymer material.

17. A method according to claim 16 wherein the acid polymer material is polyethylene acrylic acid copolymer.

18. A method according to claim 1 and comprising adding a surfactant to the mixture.

19. A method according to claim 18 wherein the surfactant is present in an amount by weight of the mixture of between 0.5 and 2.5%.

20. A method according to claim 19 wherein the surfactant is selected from the group consisting of: 2,4,7,9-tetramethyl-5-decyn-4,7-diol; 2,4,7,9-tetramethyl-5-decyn-4,7-diol+3.5 moles ethylene oxide; and sodium dodecyl sulfate.

21. A method according to claim 20 wherein the surfactant is 2,4,7,9-tetramethyl-5-decyn-4,7-diol.

22. A method according to claim 20 wherein the surfactant is 2,4,7,9-tetramethyl-5-decyn-4,7-diol+3.5 moles ethylene oxide.

23. A method according to claim 21, wherein after addition of the surfactant, the mixture comprises between 1% and 1.5% by weight surfactant.

24. A method according to claim 20 wherein the surfactant is sodium dodecyl sulfate.

25. A method according to claim 24 wherein after addition of the surfactant, the mixture comprises between 2% and 2.5% by weight surfactant.

26. A method according to claim 1 wherein the first material is dissolved in water, to form an aqueous solution.

27. A method according claim 26 wherein the aqueous solution of the first material comprises between 2% and 10% by weight of the first material.

28. A method according to claim 26 wherein the second material is dispersed in water.

29. A method according to claim 28 wherein the aqueous dispersion of the second material comprises between 2% and 10% by weight of the second material.

30. A method according to claim 1 wherein forming the layer comprises preparing the mixture in accordance with a procedure comprising:

preparing an aqueous solution of the first material;

preparing an aqueous dispersion of the second material; and mixing the aqueous solution and the aqueous dispersion.

31. A method according to claim 1 wherein forming the layer comprises forming a layer of an aqueous mixture that does not release organic compounds into the air during drying thereof.

32. A method according to claim 1 wherein forming the layer of the mixture on the surface comprises applying the mixture to the surface using a gravure roller.

* * * * *